United States Patent [19]

Stanley et al.

[11] Patent Number: 4,518,831

[45] Date of Patent: May 21, 1985

[54] TRANSDUCER WITH TRANSLATIONALLY ADJUSTABLE ARMATURE

[75] Inventors: W. Kent Stanley; George C. Tibbetts, both of Camden, Me.

[73] Assignee: Tibbetts Industries, Inc., Camden, Me.

[21] Appl. No.: 548,838

[22] Filed: Nov. 4, 1983

[51] Int. Cl.[3] ..... H04R 11/00

[52] U.S. Cl. ..... 179/119 A; 179/114 A; 310/25; 335/235

[58] Field of Search ..... 179/119 A, 114 A, 119 R, 179/117; 310/25; 335/235

[56] References Cited

U.S. PATENT DOCUMENTS 3,531,745 9/1970 Tibbetts ..... 335/231
3,935,398 1/1976 Carlson ..... 179/114 A
4,272,654 6/1981 Carlson ..... 179/119 A
4,410,769 10/1983 Tibbetts ..... 310/25

*Primary Examiner*—Gene Z. Rubinson
*Assistant Examiner*—L. C. Schroeder
*Attorney, Agent, or Firm*—Kenway & Jenney

[57] ABSTRACT

An electromechanical magnetic transducer with a moving armature having (1) substantially pure translational adjustability, or (2) adjustability characterized by a substantially definite pre-chosen ratio of rotation to translation. The armature comprises an armature leg and an armature support yoke having plastically deformable yoke arms. A yoke arm comprises a pair of struts that are mutually inclined to provide a toggle-like action upon application of an adjusting force, such action opposing or enhancing the tendency of the support of the armature leg to rotate.

14 Claims, 5 Drawing Figures

FIG. 4
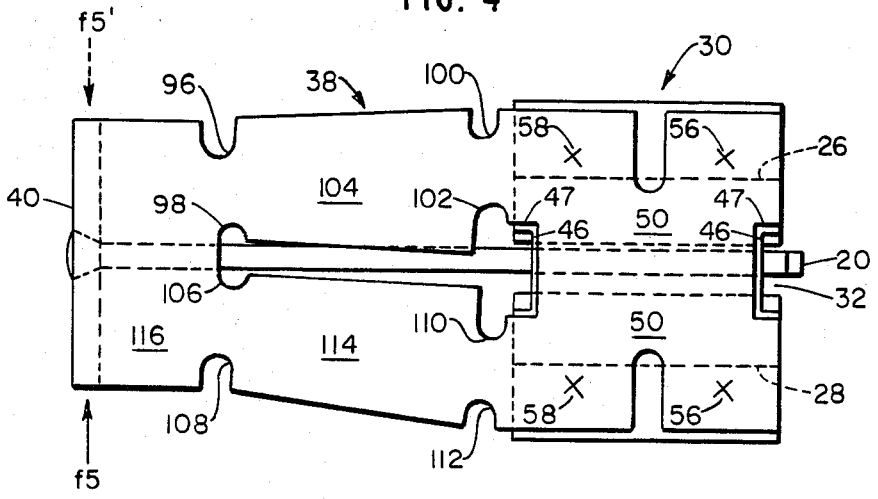
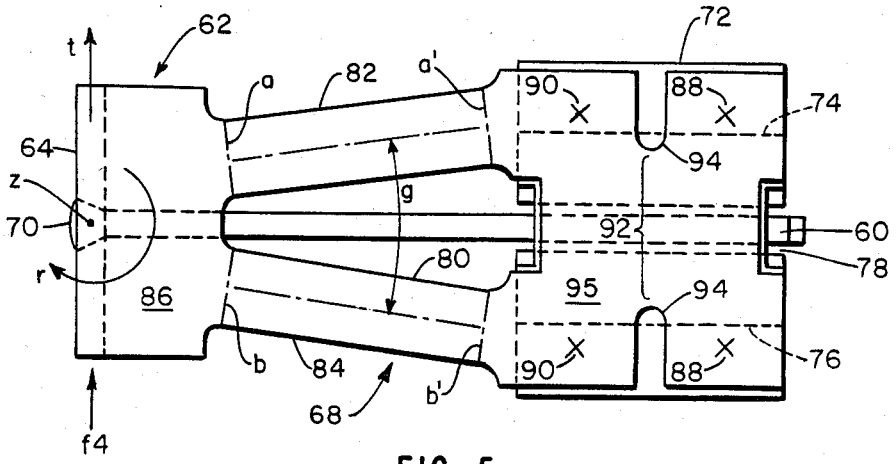
FIG. 5

TRANSDUCER WITH TRANSLATIONALLY ADJUSTABLE ARMATURE

RELATED APPLICATION

This application relates to electromechanical transducers of the general type described in the copending U.S. application of George C. Tibbetts Ser. No. 328,857, filed Dec. 9, 1981, now U.S. Pat. No. 4,410,769 dated Oct. 18, 1983, and describes certain improvements in such transducers and the methods of adjusting the same.

BRIEF SUMMARY OF THE INVENTION

This invention relates generally to electromechanical magnetic transducers of the type having a moving armature that is adjustable relative to the working gap. The above copending application describes an armature comprising an armature leg, crosspiece, and yoke arms, the adjustment being accomplished by inelastic distortion of the yoke arms.

In certain of the embodiments in said application, substantially translational movement of the intrinsic position of the armature leg during adjustment is achieved by providing in each yoke arm one or more struts that undergo S-shaped distortion upon application of adjusting forces in appropriate directions. These structures are further adapted for rotational adjustments of the armature leg in the gap at an earlier stage of assembly. Adjusting tabs or plates, respectively integral with or attached to the yoke arms, are provided with perforations located at positions where the adjusting forces can be appropriately directed so as to achieve a substantially translational movement of the intrinsic position of the armature leg. Further, the locations where the adjusting forces are applied are such that the adjustments usually must be made prior to completion of the assembly of the transducer within its casing.

In such embodiments the necessity for providing adjusting tabs or plates affects the practical design of the transducer by increasing the overall height or width respectively. In FIG. 7 of said application, however, an embodiment is shown that includes neither adjusting tabs nor adjusting plates. This embodiment is useful when a transducer of limited height is desired. However, the application of adjusting forces to that embodiment provides merely quasi-translational adjustment of the intrinsic position of the armature leg in the working gap between the magnet pair as contrasted to the substantially pure translational adjustment that is usually desired. This results from the fact that the adjustment force is applied to the yoke arm between the crosspiece and the adjacent ends of the struts, rather than essentially centrally between respective ends of each strut, so that a considerable rotation is imparted to the armature leg during adjustment.

It is a principal object of this invention to provide new armature structures with which a more accurately translational adjustment of the intrinsic position of the armature leg in the working gap may be achieved without the necessity of resorting to the use of adjusting tabs or plates.

A second object of the invention is to provide improved armature means of a type exhibiting less elastic recoil upon release of the adjusting force.

A third object is to provide armature means having improved self-shielding of the transducer.

Further objects, related to the foregoing, are to provide improved armature means having greater simplicity of structure and which can be more easily fabricated. Such structures are adapted to motor units of restricted height, enabling the use of the foregoing type of adjustment in the thinnest moving armature transducers available in the present state of the art. These objects also contemplate a method of adjustment, and fixtures required for such adjustment, that are simpler than those contemplated by the above application. Moreover, it is desired to provide structures wherein the location and method of application of the adjusting forces are such that the method of adjustment can be applied to motor units that are partially or wholly enclosed in casings of the entire transducer.

More generally, it is a further object of the invention to provide, in certain transducer structures, new armature means which confer a pre-chosen ratio between rotation and translation components of adjustment, upon application and release of an adjusting force, such ratio being particularly adapted to the transducer structure.

With the foregoing objects in view, the present invention provides improved armature means having mutually inclined plastically deformable struts in the armature yoke arm structure, so that the kinematic effects of the mutually inclined struts, as they move during adjustment, contribute a rotation which substantially modifies the rotation that otherwise would take place.

Other features of the invention comprise structural features and combinations that will be evident from the following description of certain embodiments thereof.

DESCRIPTION OF THE DRAWING

FIG. 4 is a side elevation of the armature of FIGS. 1 to 3, illustrating the effects of applying an adjusting force to de-center the adjustment of the armature leg within the working gap.

FIG. 5 is an elevation of an alternative embodiment of the armature means employing prismatic struts.

DETAILED DESCRIPTION

Figure 1:
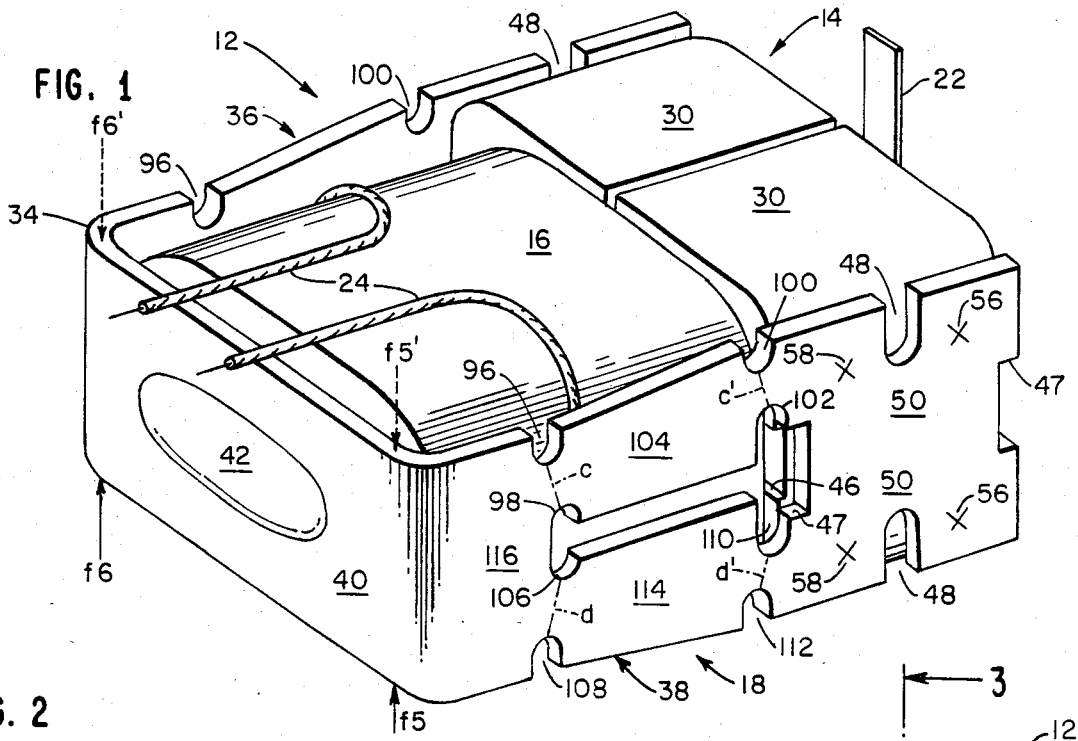
FIG. 1 is an isometric view of a fully assembled electromechanical transducer or motor unit including the presently preferred embodiment of the armature means according to this invention.
Figure 2:
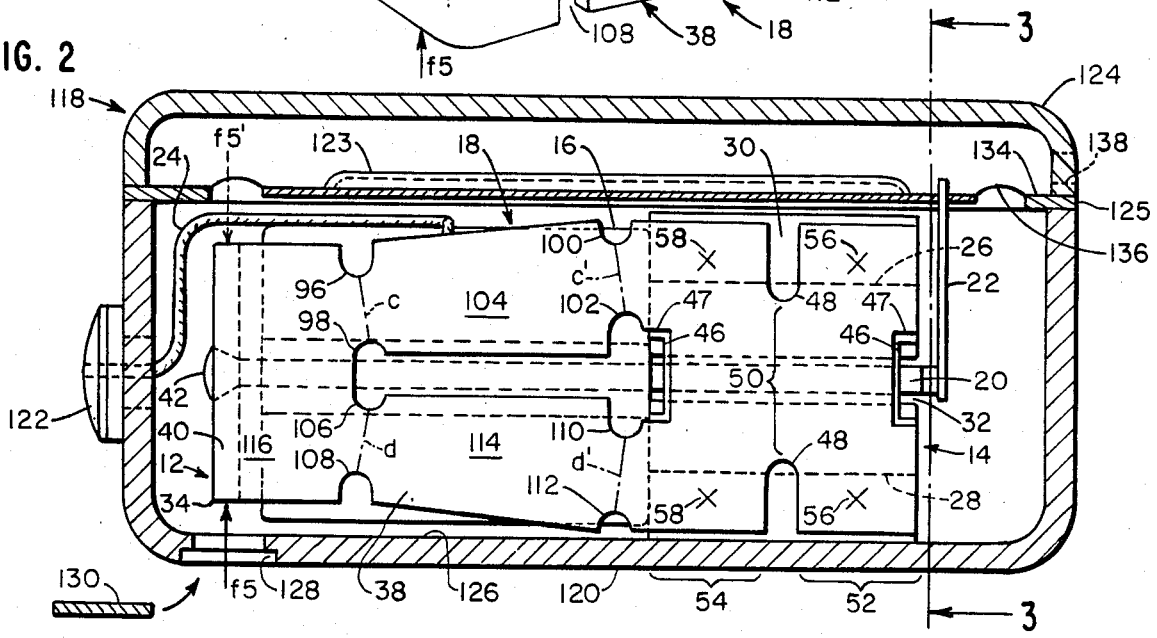
FIG. 2 is an elevation in section showing the transducer of FIG. 1 assembled in a case to provide an electroacoustic transducer.
Figure 3:
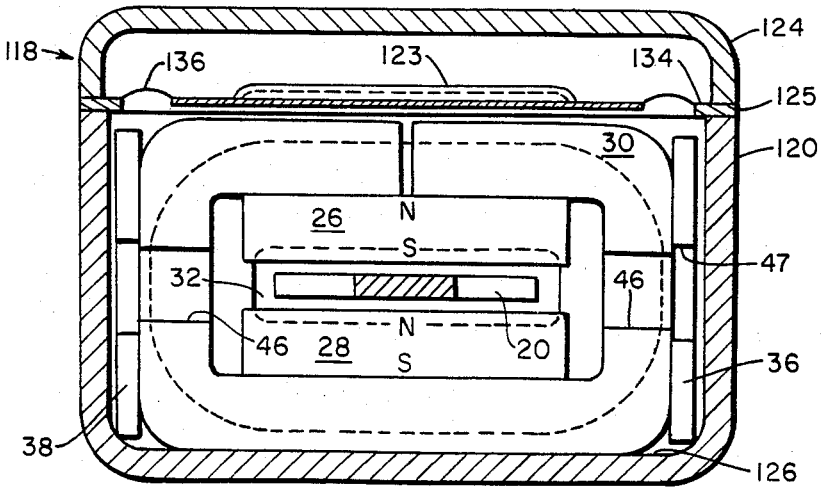
FIG. 3 is an elevation in section taken on line 3—3 of FIG. 2.

Referring to FIGS. 1 to 3, there is shown an electromechanical transducer or motor unit designated generally at 12, comprising polarizing flux means 14, an electrical coil 16, and armature means 18. The armature means includes an armature leg 20, the otherwise free end of which is attached to a pin 22. In a receiver embodiment as illustrated in FIGS. 2 and 3, an electrical signal current through the coil leads 24 causes the armature leg and the attached pin 22 to deflect.

The polarizing flux means 14 consists of a pair of permanent magnets 26 and 28 and a magnet strap 30 of high permeability magnetic material in the form of a flat strip folded into a substantially rectangular, closed configuration. The magnets 26 and 28 are secured to the strap 30 and have substantially flat, mutually parallel opposed surfaces forming a working gap 32.

The armature means 18 is also formed of high permeability magnetic material and comprises the armature leg 20 and an armature support yoke 34. The armature support yoke is formed from a flat sheet and folded to define a pair of yoke arms 36 and 38 joined by an integral crosspiece 40. The armature leg 20 is formed from a flat sheet and is elongate and of generally rectangular shape. An end of the armature leg is attached to the crosspiece 40 by a high strength, stable weld 42, for example a laser weld. The coil 16 surrounds the armature leg and fits within the space provided between the crosspiece 40 and the magnet strap 30 with clearance from the crosspiece, and is secured initially to the magnet strap 30.

Sighting slots 46 are formed in the magnet strap 30, and corresponding sighting slots 47 are formed in the ends of the yoke arms, to permit observation of the position of portions of the armature leg in the working gap.

Each of the yoke arms has a pair of notches 48 forming a necked region 50. These necked regions connect between end portions 52 and end portions 54 of the yoke arms (FIG. 2). The end portions 52 and 54 fit closely against the magnet strap 30, and end portions 52 are attached to it by a pair of resistance welds 56. The fully assembled transducer also has a pair of resistance welds 58 that attach the end portions 54 of the yoke arms to the magnet strap 30.

The structure of the improved armature means according to this invention can be more readily appreciated by considering first the alternative embodiment of FIG. 5. This embodiment includes an armature leg 60, and an armature support yoke 62 which in turn comprises a crosspiece 64 and yoke arms 66 (not shown) and 68. The crosspiece 64 and yoke arms 66 and 68 are integral, while the armature leg 60 is attached to the crosspiece 64 by a laser weld 70. A magnet strap 72 lies between and is attached to the yoke arms 66 and 68, and supports magnets 74 and 76 that provide the working gap 78 between their opposing faces. The armature leg 60 extends into the working gap 78. The electrical coil, corresponding to the coil 16 of FIGS. 1 to 3, is omitted for clarity of illustration.

The yoke arm 68 is contoured on its periphery, and has a contoured aperture 80, to provide prismatic struts 82 and 84 which are mutually inclined at the angle g. A portion 86 of the yoke arm 68, which lies between the crosspiece 64 and the struts 82 and 84, is of appreciable extent and strength, and moves approximately as a rigid body during the adjustments described below. The remaining portion 95 of the yoke arm 68 overlaps the magnet strap 72 and is attached thereto by weld pairs 88 and 90. Sighting slots similar to the slots 46 and 47 of FIGS. 1 to 3 are also provided.

As described in said copending application, the yoke arm 68 is provided with a necked region 92 by means of a pair of notches 94. As in one procedure described in said application, the yoke arm 68 is first attached to the magnet strap 72 by the pair of welds 88, and thereafter the necked region 92 is deformed in order to adjust the armature leg 60 substantially parallel to the faces of the magnets 74 and 76 within the working gap 78. Subsequently the pair of welds 90 are applied to prevent further deformation of the necked region 92.

At any time after completion of the pair of welds 90, the magnet strap 72 can be held in a substantially fixed position, and the intrinsic position of the armature leg 60 in the working gap 78 can be altered by the temporary application of adjusting forces, such as the force f4, to the edge of the crosspiece 64. During the application of the adjusting force or forces, portions of the struts 82 and 84 near their ends deform plastically, and these restricted regions of plastic deformation are shown in an idealized way in FIG. 5 as surfaces or junctions a, a′ and b, b′. The bulk of the struts 82 and 84 do not appreciably deform plastically, and except for elastic effects these interior regions move approximately as rigid bodies.

For convenience of description, an axis z is chosen to intersect the force vector f4 and to lie in the plane of initial symmetry possessed by the particular embodiment of the yoke arm shown in FIG. 5 (yoke arm 68). Since the adjusting force f4 causes very little motion of the portion 86 in the direction of the length of armature leg 60, the motion of the portion 86 (relative to portion 95), upon the application and release of adjusting force f4, can be described with sufficient accuracy by the combination of the translation t and the rotation of angle r about the axis z.

Upon the application of the adjusting force f4, moments result at all of the junctions a, a′, b and b′, and in consequence of these moments the struts 82 and 84 pivot plastically, at each respective junction, relative to each of the portions 86 and 95. In addition, since the entire yoke arm supports the force f4 in a manner analogous to a cantilever, the force f4 also applies a net compressive force to the junctions a, a′, and a net tensile force to the junctions b, b′. As a result, plastic crushing occurs at the junctions a, a′ and plastic stretching occurs at the junctions b, b′, as components of the total plastic deformation. As a consequence, if the embodiment of FIG. 5 were altered so that the struts 82 and 84 were not inclined toward one another, the portion 86 would undergo not only an upward translation t but also a clockwise rotation r, with the result that parallelism of the intrinsic position of armature leg 60 in the working gap 78 would not be substantially maintained.

Considering now the effect of inclining the struts 82 and 84 as shown in FIG. 5, upon the application of the adjusting force f4, crushing at the junctions a, a′ and stretching at the junctions b, b′ still occur; however, the strut 82 as it pivots upwardly acts as a toggle and tends to push the upper part of the portion 86 to the left, as viewed in the drawing, while the strut 84 as it pivots upwardly tends to pull the lower part of the portion 86 to the right. These latter motions of kinematic origin contribute to the total motion of the portion 86, tending to rotate portion 86 counter-clockwise. Potentially, they are capable of providing a null result for the total rotation r of the portion 86 in the situation that elastic effects are neglected, that only fully developed plastic flow is considered, and that the change of geometry as deformation proceeds, other than as described above, is neglected. Further, the adjusting force f4 also causes some upward slip in shear in directions along each of the junctions, and it can be seen from FIG. 5 that this effect of shear also contributes a slight counterclockwise rotation component to the motion of the portion 86.

We have found that the correct choice of angle between the struts 82 and 84, for certain ranges of the parameters that describe the geometry of the yoke arm 68, does in fact give zero rotation of the portion 86 in the case of plastic flow, that these admissible ranges of the parameters correspond to practical structures, and that in such structures a suitable choice of angle between the struts provides substantially pure translational adjustment of the intrinsic position of the armature leg within the working gap.

For more general choices of angle between the struts 82 and 84, the rotation r is no longer substantially zero; instead the angle g determines, within limits set by other parameters, the sign and magnitude of the particular ratio r/t achieved upon the adjustment of the structure by the force f4. In certain transducers, the working gap 78 may be tapered rather than uniform between the opposing faces of the magnets 74 and 76. For this or other reasons, a substantially definite, non-zero, value of r/t may be desired, and this may be achievable by the choice of angle g and other parameters. As an arbitrary example of the effect of the angle g, if g is negative, i.e. the spacing of the respective axes, parallel to axis z, which bisect the area of junctions a, b is greater than the corresponding spacing of junctions a', b', the motions of kinematic origin tend to rotate portion 86 clockwise, thus enhancing the total rotation r. On the other hand, if g exceeds the angle that corresponds to zero rotation r, then in general the total rotation r is negative (counter-clockwise).

We next turn to a further description of the preferred embodiment of the invention as illustrated in FIGS. 1 to 4. The struts are not prismatic as in FIG. 5, but have a height that has been increased as much as possible in order to reduce the magnetic reluctance of each strut in its interior region. In this embodiment, pairs of notches such as 96, 98 and 100, 102, define each end of a strut such as 104; and similarly, pairs of notches 106, 108 and 110, 112 define each end of a strut 114. As a result of the notches, the actual regions of plastic deformation, idealized in FIGS. 1 and 2 by broken lines c, c' and d, d', are smaller and more localized. An important advantage of this embodiment is that it exhibits less elastic recoil upon the removal of an adjusting force, and this is a consequence of the greater stiffness in edgewise bending of the heightened struts and also of the more restricted regions of plastic deformation.

FIG. 4 illustrates the effect of applying an adjusting force f5 to de-center the adjustment of the embodiment shown in FIGS. 1 to 3. Thus the intrinsic position of the armature leg 20 has been moved close to the opposing face of the magnet 26, while substantially maintaining parallelism within the working gap 32. As discussed in said copending application, it is the intrinsic position of the armature leg in the working gap that is of concern. If the effects of magnetic forces are neglected, or alternatively if the structure is considered in the condition prior to magnetization of the magnets 26 and 28, the armature leg 20 can be moved by means of adjusting forces f5 or f5' throughout the range of the working gap 32, from near-contact with the magnet 26 to near-contact with the magnet 28, while remaining at all times (after release of adjusting force) substantially parallel with the opposing faces of the magnets 26 and 28.

The adjusting forces described above may be applied at any of several locations, such as a force centered on the mid-plane of the crosspiece, or a force applied over any portion of the armature support yoke behind the struts, for example the portion 86 of FIG. 5 or a corresponding portion 116 in FIG. 4. However, it should be noted that the choice of the angle between the struts to give optimally translational adjustment, or alternatively a certain value of the ratio r/t, depends on the choice of location for the application of adjusting forces.

Further advantages of this invention can be appreciated from a consideration of FIGS. 2 and 3 illustrating the assembly of the transducer 12 with other parts forming an electroacoustic transducer designated generally at 118. The transducer 12 is mounted in a cup-like casing 120 of substantial strength, which is provided with terminal pads 122 to receive the coil leads 24. A diaphragm 123 has a peripheral frame 134 located on the lip of the casing 120 and a cup-like cover 124 is butted to the frame, the casing, cover and frame all being joined together at the four corners of the assembly, for example by laser welds (not shown) at each corner such as 125. This provides a box-like enclosure fabricated from a high permeability magnetic material to provide magnetic shielding to the electroacoustic transducer 118. Before insertion in the casing 120, the transducer 12 is fully assembled as shown in FIG. 1 with the pin 22 attached to the end of the armature leg 20. The coil 16 has been bonded to the magnet strap 30. Also, certain steps of preadjustment will also have been carried out employing one of the methods described in said copending application. In the embodiment shown, the yoke arms are first attached to the magnet strap 30 by the pair of welds 56, and thereafter the necked region 50 is deformed in order to adjust the armature leg 20 to be substantially parallel to the faces of the magnets 26 and 28 within the working gap 32. Subsequently the pair of welds 58 is applied to prevent further deformation of the necked region 50.

Upon the insertion of the motor unit 12 into the casing 120, the magnet strap 30 is attached to the case bottom 126, for example by resistance welding. Two or more coil leads 24 extend through the end wall of the casing 120 to the terminal pads 122. After completion of this stage of the assembly, the magnets 26 and 28 are magnetized by exposing the assembly to a sufficiently strong magnetic field.

The adjustment of the motor unit 12 within the assembly is made by demagnetizing the magnets 26 and 28 to the desired operating point, while concurrently applying the adjusting force pairs f5, f6 or f5', f6' to the edges of the crosspiece 40 for the purpose of adjusting the intrinsic position of the armature leg 20 within the working gap 32. The adjusting forces are applied by pins which thrust against the edges of the crosspiece 40. For access to the bottom edge of the crosspiece a pair of coined apertures 128 is provided in the case bottom 126 near the ends of the crosspiece. After all adjustments have been made, the apertures 128 may be closed by inset discs 130 which are bonded into place with an adhesive.

There are considerable advantages in the described structure which permits adjustment of the motor unit 12 while it is within the casing member 120. In particular, the welding of the magnetic strap 30 to the case bottom 126 may be carried out before the magnets are magnetized; and similarly, the coil leads 24 can be terminated at the terminal pads 122 and soldered thereto before the adjustments are made.

After the foregoing adjustments, further steps of assembly can be carried out. These include the provision of the diaphragm 123 which preferably has a central shaped portion formed in it for stiffening, is supported at its periphery by a surround 136 and at one end by a flexural pivot (not shown), and which at its other end connects with the armature leg 20 by means of the pin 22 (FIG. 2). Means for acoustical communication with the space between the diaphragm 123 and the cover 124 are of conventional form, and include a slot 138 in the cover 124.

In certain cases, it may be desired to complete the final adjustment of the motor unit 12 within the transducer after it has been completely assembled as described above with the exception of the closure discs 130. Thus, although the diaphragm 123 and cover 124 will prevent access to the top edge of the crosspiece 40, adjustment can still be made at the bottom edge through the apertures 128. Thus, means are provided for a final adjustment at a quality control checkpoint when the transducer is substantially a completed assembly.

We claim:

1. An electromechanical transducer having in combination, polarizing flux means comprising at least one permanent magnet and a pair of spaced, facing pole surfaces defining a gap, and armature means comprising a flux conductive armature leg extending into the gap, and an adjustable support arm fixed to the armature leg remote from the gap and extending to a substantially fixed support relative to the pole surfaces, the support arm comprising a pair of plastically deformable struts that extend along a substantial portion of the support arm and that are mutually spaced in a direction generally perpendicular to the pole surfaces, the spacing being less at one end of the pair of struts than at the other end.

2. The combination of claim 1, in which the difference in the spacing of the struts at their ends defines an angle, said angle being selected to produce substantially pure translational adjustment of the intrinsic position of the armature leg within the gap upon the application in said direction and subsequent release of an adjusting force to the support arm at a position separated from the polarizing flux means by the struts.

3. The combination of claim 1, in which the difference in the spacing of the struts at their ends defines an angle, said angle being selected to produce, upon the application in said direction and subsequent release of an adjusting force to the support arm at a position separated from the polarizing flux means by the struts, a translational adjustment and a rotational adjustment of the intrinsic position of the armature leg within the gap, the ratio of said adjustments being substantially predetermined by said angle.

4. The combination of claim 1, in which the support arm has a closed slot separating the struts.

5. The combination of claim 4, in which the slot has opposed edge portions thereof that are mutually spaced a greater distance at one end of the pair of struts than at the other end.

6. The combination of claim 5, in which the struts are substantially prismatic.

7. The combination of claim 4, in which the end portions of the struts are at least partially defined by notches in edge portions of the slot.

8. The combination of claim 7, in which the two end portions of each strut have substantially the same minimum cross sectional area.

9. The combination of claim 7, in which the end portions of the struts are further defined by notches in peripheral edge portions of the support arm.

10. The combination of claim 1, in which the armature means comprises a substantially mirror symmetrical pair of support arms, said pair including a unitary crosspiece fixed to and extending laterally from the armature leg in opposite directions.

11. The combination of claim 1, in which the support arm comprises a crosspiece fixed to the armature leg, the crosspiece being substantially flat and perpendicular to the direction of the armature leg.

12. The combination of claim 11, in which the support arm extends beyond the crosspiece substantially in a plane parallel to both of said directions.

13. The combination of claim 1, in which the armature leg and support arm are integral where fixed together.

14. The combination of claim 1, with a cup-like casing having an aperture located for inserting a tool to apply an adjusting force to the support arm.

* * * * *